US009895046B1

(12) United States Patent
Wilson et al.

(10) Patent No.: US 9,895,046 B1
(45) Date of Patent: Feb. 20, 2018

(54) DISHWASHER RACK LIFT SYSTEM

(71) Applicant: Midea Group Co., Ltd., Foshan (CN)

(72) Inventors: Mark W. Wilson, Simpsonville, KY (US); Timothy Martin Wetzel

(73) Assignee: Midea Group Co., Ltd., Beijiao, Shunde Foshan, Guangdong (CN)

( * ) Notice: Subject to any disclaimer, the term of this patent is extended or adjusted under 35 U.S.C. 154(b) by 0 days.

(21) Appl. No.: 15/391,733

(22) Filed: Dec. 27, 2016

(51) Int. Cl.
*A47L 15/00* (2006.01)
*A47L 15/50* (2006.01)
*A47B 88/90* (2017.01)

(52) U.S. Cl.
CPC ..... *A47L 15/504* (2013.01); *A47L 15/507* (2013.01); *A47B 2088/901* (2017.01)

(58) Field of Classification Search
CPC ..... A47L 15/50; A47L 15/504; A47L 15/506; A47L 15/507; A47B 2088/901
See application file for complete search history.

(56) References Cited

U.S. PATENT DOCUMENTS 3,005,672 A 10/1961 Becker
3,466,105 A 9/1969 Guth
3,726,580 A 4/1973 Guth
3,809,450 A 5/1974 Guth
3,822,085 A 7/1974 Clark
3,892,453 A 7/1975 Daily
3,982,801 A 9/1976 Heidorn et al.
4,097,099 A 6/1978 Spiegel
4,644,693 A 2/1987 Wang
5,115,822 A * 5/1992 Nichols ..... A47L 15/506 134/135
5,474,378 A 12/1995 Smith et al.
5,595,200 A 1/1997 Favaro
5,657,878 A 8/1997 Austin
5,971,513 A * 10/1999 Cassalia ..... A47L 15/506 312/272
6,142,551 A 11/2000 Ciavaglia et al.
6,223,469 B1 5/2001 Moll
6,247,771 B1 * 6/2001 Miller ..... A47L 15/506 312/272
6,571,808 B2 6/2003 Todd
6,755,490 B2 6/2004 Welch et al.
7,424,893 B2 9/2008 Kim
7,621,605 B2 * 11/2009 Bond ..... A47B 46/00 312/311
7,628,461 B2 12/2009 Carden et al.
(Continued)

FOREIGN PATENT DOCUMENTS

CA 2394277 A1 2/2003
CA 2582685 A1 5/2008
(Continued)

OTHER PUBLICATIONS

Dean Dobson, Bethany Hyvarinen, Katie Roberts, "Ergonomically Sound Design of a Bottom Dishwasher Rack," Dec. 2002.

*Primary Examiner* — Daniel J Rohrhoff
(74) *Attorney, Agent, or Firm* — Middleton Reutlinger

(57) ABSTRACT

A dishwasher rack for a dish washing appliance. The dishwasher rack may be positionable between a variety of height positions. A drive mechanism may assist the dishwasher rack between the vertical positions. A worm screw may be coupled to a motor and may be positioned within the dishwasher tub.

18 Claims, 10 Drawing Sheets

(56) References Cited

U.S. PATENT DOCUMENTS

| | | | | |
|---|---|---|---|---|
| 8,061,790 | B2 | 11/2011 | Anikhindi et al. | |
| 8,067,915 | B2 | 11/2011 | Hooker et al. | |
| 8,162,419 | B2 | 4/2012 | Dellby et al. | |
| 8,283,610 | B2 | 10/2012 | Hirano | |
| 8,303,053 | B2 | 11/2012 | Bond et al. | |
| 8,668,289 | B2 | 3/2014 | Lee et al. | |
| 8,813,766 | B2 | 8/2014 | Bhajak et al. | |
| 9,121,217 | B1 | 9/2015 | Hoffberg | |
| 9,377,238 | B2 * | 6/2016 | Hall | F25D 25/025 |
| 2003/0042825 | A1 | 3/2003 | Welch et al. | |
| 2004/0163687 | A1 | 8/2004 | Son et al. | |
| 2004/0244825 | A1 | 12/2004 | Ashton | |
| 2006/0021373 | A1 * | 2/2006 | Oh | F25D 25/025 62/407 |
| 2006/0043848 | A1 * | 3/2006 | Jeong | A47B 46/00 312/310 |
| 2008/0018215 | A1 * | 1/2008 | Carden | F25D 25/025 312/404 |
| 2008/0129168 | A1 | 6/2008 | Banta et al. | |
| 2009/0009040 | A1 * | 1/2009 | Dellby | A47L 15/506 312/228.1 |
| 2012/0074080 | A1 * | 3/2012 | Garcia | A47B 46/005 211/41.9 |
| 2013/0125937 | A1 | 5/2013 | Baldwin et al. | |
| 2014/0246008 | A1 | 9/2014 | Martin | |
| 2016/0309982 | A1 * | 10/2016 | Gerstner | A47L 15/506 |
| 2016/0331206 | A1 * | 11/2016 | Gerstner | A47L 15/506 |
| 2017/0135554 | A1 * | 5/2017 | Park | A47L 15/16 |

FOREIGN PATENT DOCUMENTS

| | | | |
|---|---|---|---|
| EP | 1066789 | A1 | 1/2001 |
| EP | 1161917 | A3 | 1/2003 |
| JP | H0634777 | Y2 | 9/1994 |
| WO | 2015185230 | A1 | 12/2015 |

* cited by examiner

DISHWASHER RACK LIFT SYSTEM

CROSS-REFERENCE TO RELATED APPLICATION

This application is related to the following application, which is filed on even date herewith and assigned to the same assignees as the present application: U.S. patent application Ser. No. 15/391,738 entitled "DISHWASHER RACK SYSTEM." The disclosure of this application is incorporated by reference herein.

BACKGROUND

The present embodiments relate to an appliance rack or shelf, with particular embodiments shown for a dishwasher rack for a dishwasher appliance.

Typical dishwasher racks, if adjustable in height at all, may include a multi-bar linkage to mechanically assist the user to swing the bottom rack out and up from the dishwasher tub. However, this structure often may contain several pinch points within the linkage, and unexpected movement may also occur. Thus, there is a need for the dishwasher rack to be capable of adjustment in the vertical direction while maintaining the ability to extend out of and/or retract into the dishwasher tub.

SUMMARY

In some embodiments of the invention, for example, a dish washing appliance may include a dishwasher tub defining a wash cavity. The appliance may include one or more dishwasher racks positioned within the wash cavity of the dishwasher tub. Moreover in some embodiments, at least one of the dishwasher racks may be moveable between a stowed position and a deployed position, wherein the deployed position may be different from the stowed position. In various embodiments, the appliance may include at least one threaded member. Further, in some embodiments, the appliance may include one or more slides coupling at least one dishwasher rack to at least one threaded member. The appliance may include at least one motor. In some embodiments, the appliance may include at least one worm screw located within the wash cavity and operably coupled to at least one motor. In various embodiments, at least one threaded member and at least one dishwasher rack may be connected to at least one worm screw. Further, at least one threaded member, one of more slides, and at least one dishwasher rack may be positionable between a first height and a second height along a length of at least one worm screw when at least one dishwasher rack is in the deployed position. Further, the second height may be at a higher vertical elevation than the first height.

In some embodiments, at least one threaded member and at least one worm screw may be positioned adjacent a rear wall of the dishwasher tub. Further in some embodiments, at least one worm screw may be located between at least one rack and the rear wall of the dishwasher tub. In various embodiments, at least one dishwasher rack may be in the stowed position in at least one height between the first height and the second height along at least one worm screw. In some embodiments, a rack support may be fixed to at least one threaded member. Further, the rack support may include one or more slides. In some embodiments, one or more guide mechanisms may be between the rack support and the dishwasher tub. Further, in some embodiments, one or more guide mechanisms may be adjacent a rear wall of the dishwasher tub.

In some embodiments, a dish washing appliance may include a dishwasher tub defining a wash cavity. Further, the dishwasher tub may include a rear wall. Moreover, in some embodiments, the appliance may include one or more dishwasher racks. Moreover, at least one of the dishwasher racks may be positionable within the wash cavity of the dishwasher tub. In some embodiments, the appliance may include at least one threaded member. In some embodiments, the appliance may include at least one motor. In some embodiments, the appliance may include at least one worm screw positioned within the wash cavity between at least one dishwasher rack and the rear wall. Moreover, at least one worm screw may be operably coupled to at least one motor. In various embodiments, at least one threaded member and at least one dishwasher rack may be connected to at least one worm screw. Further, at least one threaded member and at least one dishwasher rack may be positionable between a first height and a second height along at least one worm screw. Further in some embodiments, the second height is at a higher vertical elevation than the first height. In various embodiments, at least one dishwasher rack is positionable between a stowed position and a deployed position when at least one threaded member and at least one dishwasher rack are capable of being positioned at one or more heights between the first height and the second height. Further, the deployed position is different from the stowed position.

In addition, in some embodiments, at least one motor may be positioned outside the wash cavity. In various embodiments, the one or more heights include at least one of the first height and the second height. Further in some embodiments, at least one dishwasher rack may include one or more slides engaging at least one dishwasher rack to at least one threaded member. In addition in some embodiments, a rack support may be fixed to at least one threaded member. Further, the rack support may include the one or more slides. In various embodiments, one or more guide mechanisms may be between the rack support and the dishwasher tub. In some embodiments, the one or more guide mechanisms may be adjacent the rear wall of the dishwasher tub. Moreover in some embodiments, at least one threaded member and at least one dishwasher rack may be positionable between the first height and the second height along at least one worm screw when in the deployed position.

In various embodiments, a dish washing appliance may include a dishwasher tub that may include at least a rear wall therein defining a wash cavity. In some embodiments, the appliance may include one or more dishwasher racks. Further in some embodiments, at least one of the dishwasher racks may be positioned within the wash cavity of the dishwasher tub. In addition in some embodiments, the appliance may include at least one threaded member. In addition in some embodiments, the appliance may include at least one motor. Moreover in some embodiments, the appliance may include at least one worm screw operably coupled to at least one motor. In various embodiments, at least one worm screw may be fixedly positioned in a substantially vertical orientation adjacent the rear wall of the dishwasher tub. In addition, in some embodiments, at least one threaded member and at least one dishwasher rack may be connected to at least one worm screw. Further in some embodiments, at least one threaded member and at least one dishwasher rack may be positionable between a first height and a second height along at least one worm screw. In various embodiments, the second height may be at a higher vertical elevation than the first height. In addition in some embodiments, at least one dishwasher rack may be positionable between a stowed position and a deployed position when at least one threaded member and at least one dishwasher rack are at one or more heights between the first height and the second height. Further, in various embodiments the deployed position may be different from the stowed position.

In addition, in some embodiments, the one or more dishwasher racks may be an upper dishwasher rack positioned above at least one dishwasher rack. In various embodiments, at least one worm screw may be located within the wash cavity of the dishwasher tub. Further in some embodiments, at least one dishwasher rack may include one or more slides engaging at least one dishwasher rack to at least one threaded member. In some embodiments, a rack support may be fixed to at least one threaded member. Further, the rack support may include the one or more slides. In addition in some embodiments, one or more guide mechanisms may be between the rack support and the dishwasher tub. In various embodiments, at least one threaded member and at least one dishwasher rack may be positionable between the first height and the second height along at least one worm screw when in the deployed position.

These and other advantages and features, which characterize several embodiments, are set forth in the claims annexed hereto and form a further part hereof. However, for a better understanding of the embodiments, and of their advantages and objectives, reference should be made to the drawings and to the accompanying description, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
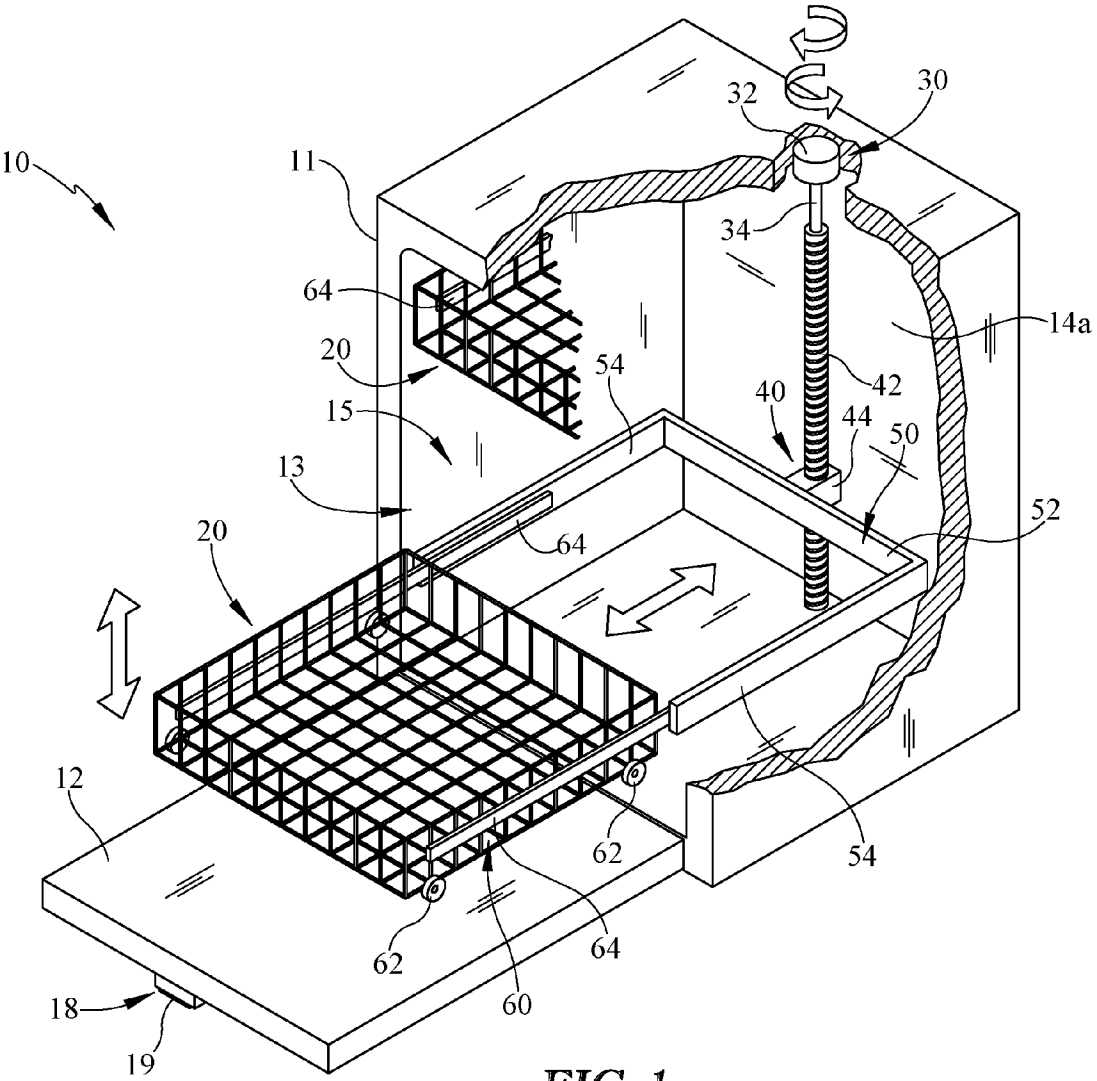
FIG. 1 is a perspective view of one embodiment of a bottom dishwasher rack illustrating at least one raised height position, with portions of the housing, upper rack, and dishwasher tub removed.
Figure 2:
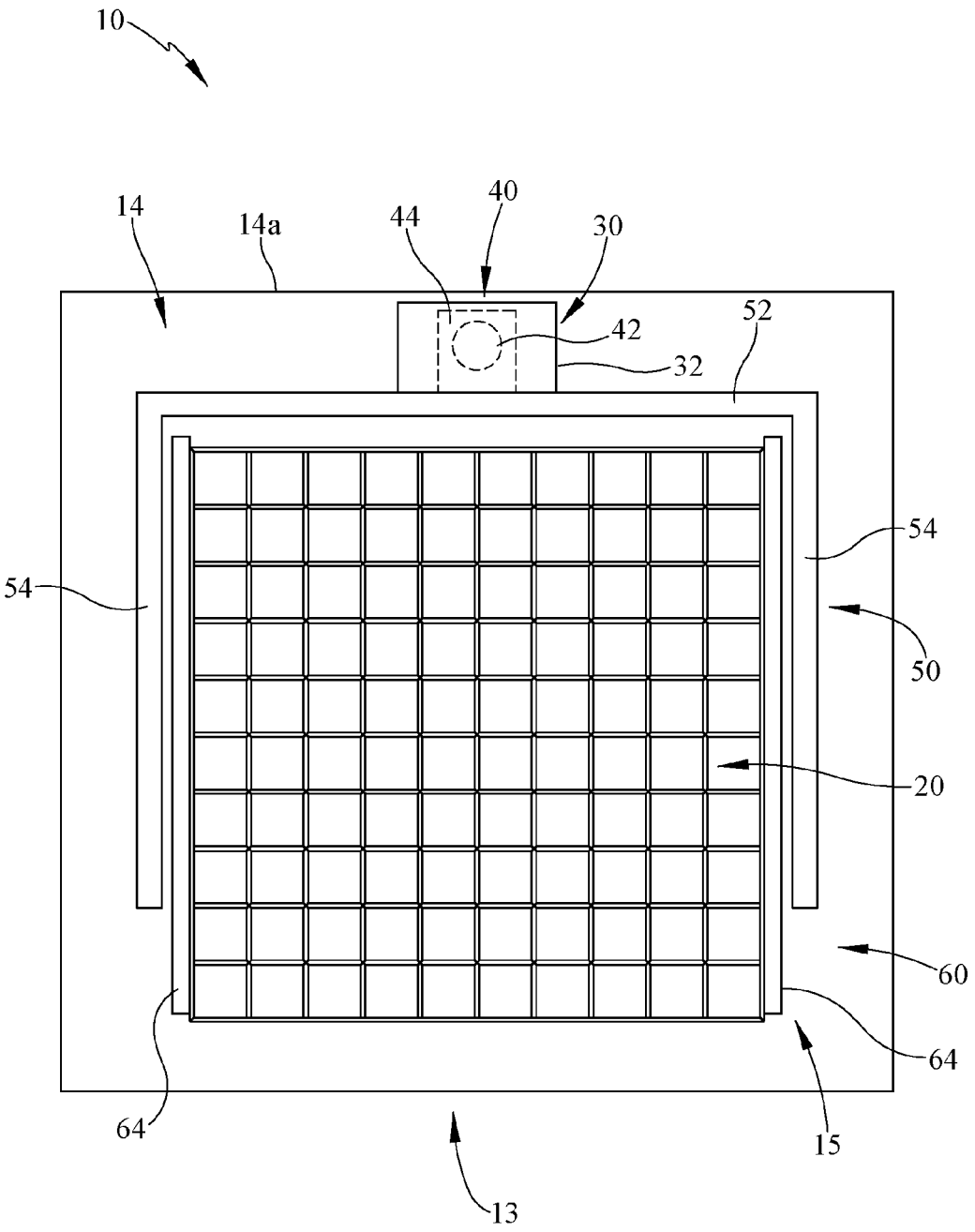
FIG. 2 is a schematic top view of the bottom dishwasher rack of FIG. 1 illustrating the dishwasher rack in the stowed position.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a front-load residential dish washing machine such as dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments. Moreover, the herein-described apparatus and techniques may be used in connection with other dish washing machine configurations, and even other appliances, such as, for example, ovens, refrigerators, and the like.

Embodiments for a dish washing machine are shown herein for ease of understanding. For example, a front-load dish washing machine that includes a front-mounted door 12 in a cabinet or housing 11 that provides access to at least one horizontally-oriented dishwasher rack 20 housed within the cabinet or housing 11 may be used. More specifically, the dishwasher rack 20 may be housed in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein.

Turning now to the drawings, wherein like numbers denote like parts throughout the several views, FIG. 1 illustrates an example dish washing appliance 10 in which the various technologies and techniques described herein may be implemented. Dish washing appliance 10 is a front-load dish washing machine, and as such may include a front-mounted door 12 (FIGS. 1 and 3) defining an opening 13 that provides access to a horizontally-oriented dishwasher tub 14. The door 12 may be coupled with a cabinet or housing 11 that may house the dishwasher tub 14. Door 12 is generally hinged along a front or front edge of the housing 11 adjacent the opening 13 and is pivotable between the open position illustrated in FIG. 1 and a closed position (not shown). When door 12 is in the open position, dishes, utensils, pans, and other washable items may be inserted into and removed from the one or more dishwasher racks 20 through the opening 13 in the front of cabinet or housing 11. Control over dish washing appliance 10, or more specifically the dishwasher racks 20, by a user is generally managed through a control panel 18 disposed on a door 12 and implementing a user interface 19 for the rack, and it will be appreciated that in different designs, control panel 18 may include various types of input and/or output devices, including various knobs, buttons, lights, switches, textual and/or graphical displays, touch screens, etc. through which a user may configure one or more settings and start and stop the dishwasher rack cycle or movement as described herein. For example, the control panel 18, or portions thereof, may be included with the dishwasher rack 20, on the interior or exterior of the door, and/or adjacent the rack within the opening of the dish washing machine. For example in some embodiments, portions of the controls may be accessible when the door 12 is in the open position. In other embodiments, the one or more racks 20 may raise and/or lower by proximity of one or more users and/or by a one or more gestures or bodily movement relative to the rack and/or portions of the dish washing machine.

Figure 3:
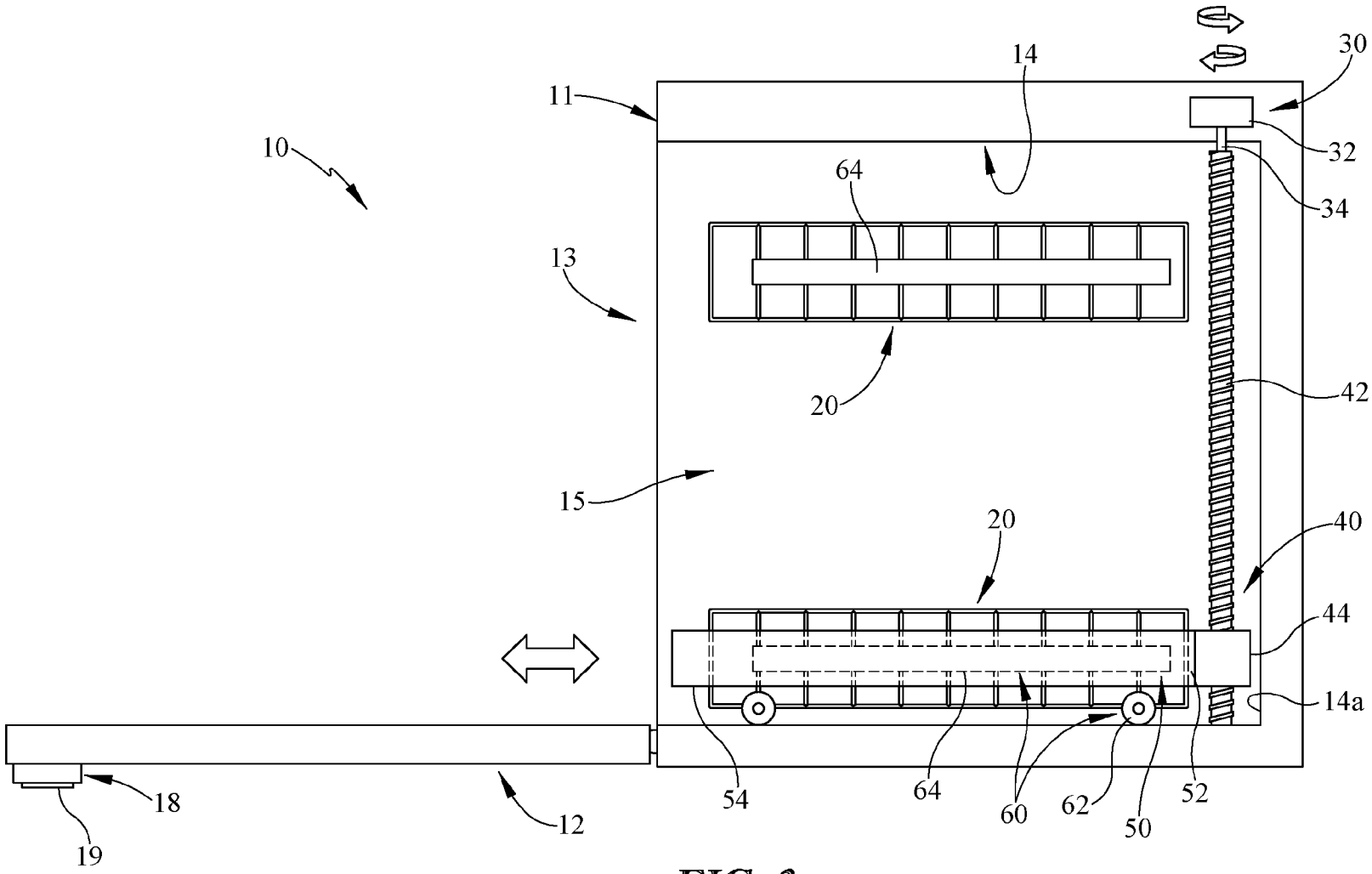
FIG. 3 is a schematic side view of the embodiment of FIG. 1 at a first height and illustrating another dishwasher rack disposed above.
Figure 4:
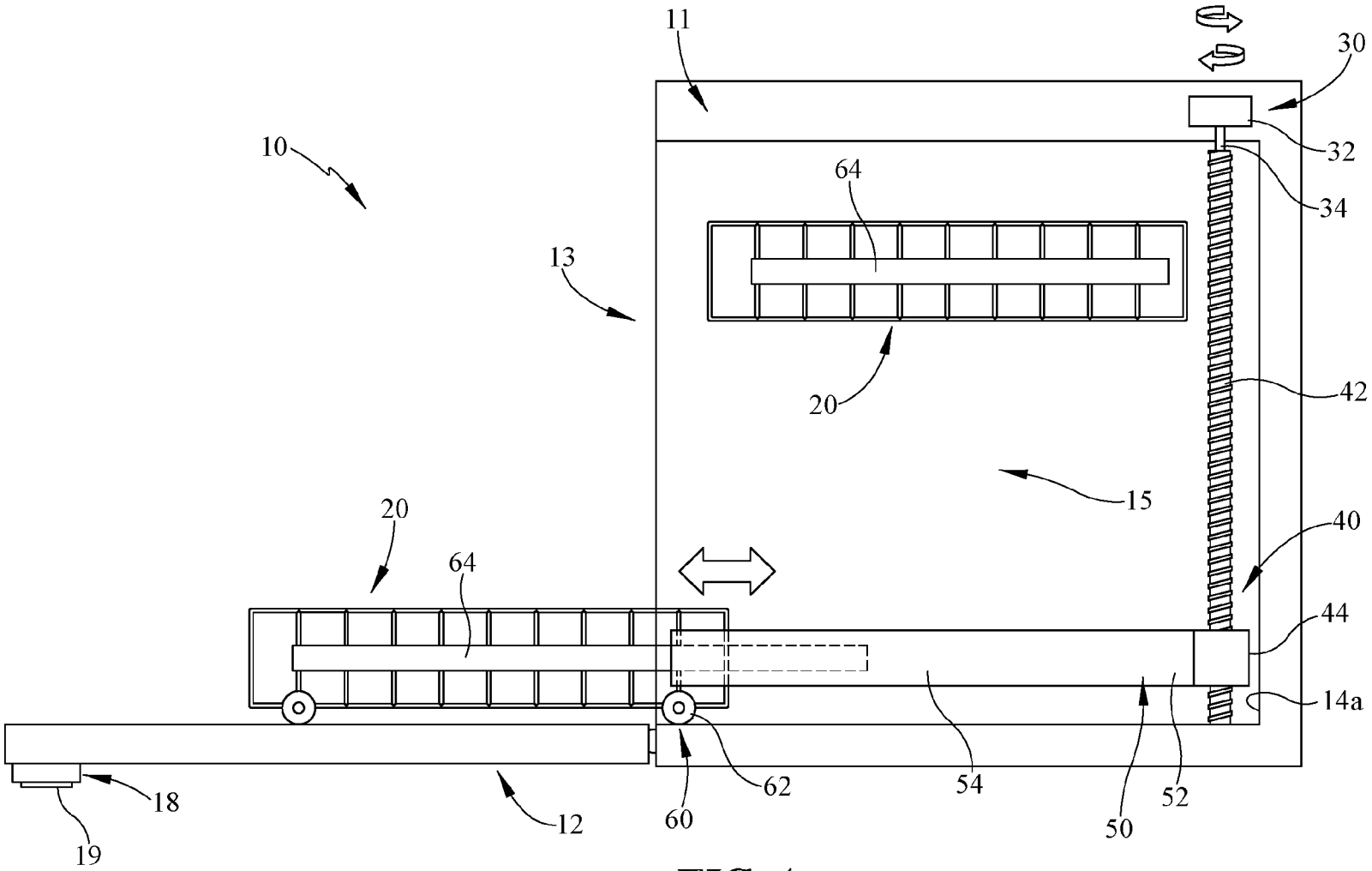
FIG. 4 is a schematic side view of the embodiment of FIG. 3 illustrating the dishwasher rack in a deployed position different from the stowed position.
Figure 5:
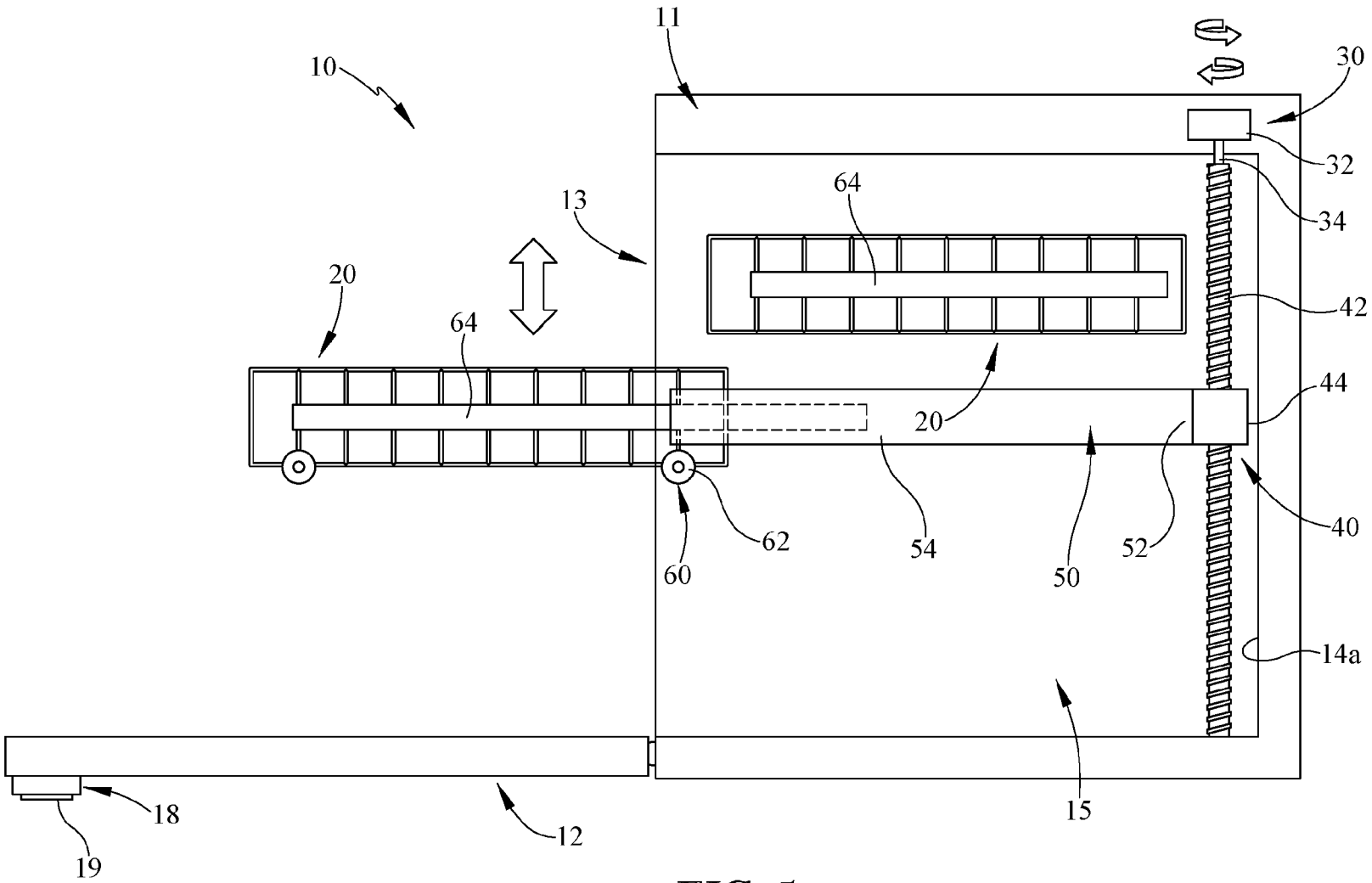
FIG. 5 is a schematic side view of the embodiment of FIG. 3 illustrating the dishwasher rack in the deployed position and at a second height.
Figure 6:
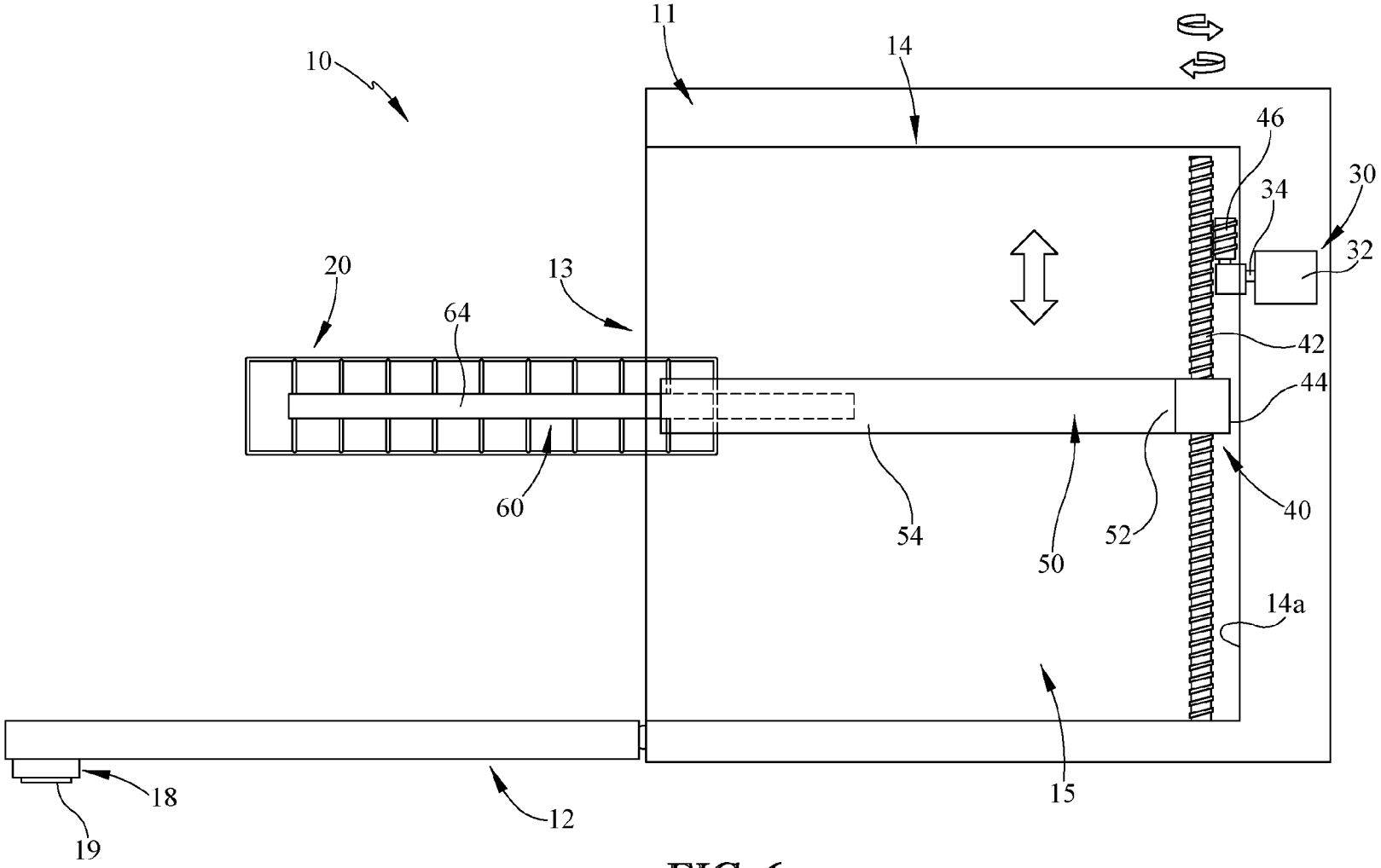
FIG. 6 is a schematic side view of another embodiment of the dishwasher rack illustrating another embodiment of a gear mechanism.

As shown in the figures, the one or more dishwasher racks 20, or portions thereof, may be moveable or positionable relative to the dish washing appliance 10 between a stowed or un-deployed position (FIGS. 1, 3, and 7-10) and a deployed or different position (FIGS. 4-6). At least one of the stowed positions of the dishwasher rack 20 may be used when one or more of the washing cycles is in operation to wash objects in the wash cavity 15. The deployed position may be one or more positions different from one or more of the stowed positions. One deployed position may be a position to dry, load, and/or unload dishes, utensils, or the like. The one or more dishwasher racks 20 may travel in one or more horizontal planes between the stowed and deployed positions. The horizontal planes may be into and/or out of the wash cavity 15 defined by the dishwasher tub 14. The wash cavity 15 may be defined by one or more walls, not limited to the rear wall 14*a*, of the dishwasher tub 14. Although the substantially linear movement of the dishwasher rack may occur along one horizontal plane as shown in one embodiment, the path of travel may be in a variety of angles, curves, and/or height positions in one or both the directions into or out of a position.

The one or more dishwasher racks 20, or portions thereof, may be positionable or operable between one or more vertical positions or heights. The dishwasher rack 20 may be positionable, raised and/or lowered, between a variety of height positions or range of height positions. The height positions may include at least a first height and at least a second height. In some embodiments, the second height (FIGS. 1 and 5) may be at a vertical elevation higher than the first height (FIG. 4). The dishwasher rack 20 may be deployed and/or stowed when the rack is in any of the one or more heights. Moreover in some embodiments, the dishwasher rack 20 may be deployed and/or stowed while the dishwasher rack is being raised and/or lowered between one or more positions. In some embodiments as shown in FIGS. 4 and 5, the dishwasher rack 20 may be raised and/or lowered between one or more heights when the dishwasher rack is in the deployed position. In some embodiments, the dishwasher rack 20 may be raised and/or lowered between one or more heights when the dishwasher rack is in the stowed position. Further the range of travel of the rack or portions of a rack may include a variety of distances and still be within the scope of the invention. For example in some various embodiments, the dishwasher rack distance of vertical travel in one or more stowed and/or deployed positions may be dependent on, but is not limited to, factors such as the location relative to another rack, the load conditions of one or more racks (i.e. dishes loaded and/or unloaded, size and/or shape of dishes), the desired height based upon one or more user preferences (i.e. on height of the user and/or desired height of the rack based on the contents within the rack to be unloaded).

In some embodiments, one or more dishwasher racks 20, or portions thereof, may be power driven by a variety of devices or drive mechanisms 30 between the variety of heights. As shown in the figures, in some embodiments one or more motors 32 may be used to raise and/or lower the one or more dishwasher racks 20. The motor 32 may drive the dishwasher rack 20 between the variety of heights, such as but not limited to, the first height and the second height. One embodiment may include an electric motor as shown with a drive shaft 34 projecting therefrom. The electric motor's rotation may correspond to the appropriate linear travel and/or direction of the dishwasher rack 20 between a variety of vertical position along any number of horizontal positions between the stowed and deployed positions. Although an electric motor is shown, it should be understood that a variety of actuators, i.e. mechanical, electro-mechanical, pneumatic, hydraulic, magnetic, pressure, or the like, may be used and still be within the scope of the invention to achieve the variety of heights of the dishwasher rack.

In various embodiments, the dishwasher rack 20 may be coupled to the drive mechanism 30 by a variety of gear mechanisms 40. In various embodiments, the dishwasher rack 20 may include a gear mechanism 40 having a worm screw 42 as shown in FIGS. 1-6 operably coupled to the motor 32. The worm screw 42 may have a substantially vertical orientation with the housing 11 or dishwasher tub 14. The worm screw 42 may be fixedly positioned relative to the dishwasher tub 14, such that in some embodiments the worm screw 42 does not travel with the dishwasher rack 20 between the stowed and deployed positions. Further, in some embodiments as shown in FIG. 6, a worm wheel 46 may be used. It should be understood that the gear mechanisms may be of a variety of quantities, sizes, orientations, positions, and constructions and still be within the scope of the invention.

As shown in FIGS. 1, 4, and 5, one embodiment of the dishwasher rack 20 may be moveable between one or more height positions. The dishwasher rack 20, or portions thereof, may be connected to the one or more worm screws 42 by one or more threaded members 44. In some embodiments, the worm screw 42 may be orientated in a vertical plane within the dishwasher tub 14. The motor 32 is coupled to a worm screw or threaded gear 42 via the motor drive shaft 34 adjacent the rear wall 14*a*. The threaded member 44 is connected to the dishwasher rack 20 and the worm screw 42. In one embodiment shown in FIGS. 1, and 3-6, the motor 32 may be positioned outside the dishwasher tub 14 wash cavity 15. Although not shown, it is understood that the motor 32 may be positioned at least partially or completely within the dishwasher tub 14 in some embodiments. The threaded member 44 may be attached to the dishwasher rack 20 such that the threaded member 44 is positionable with the rack 20 between the first height (FIG. 4) and the second height (FIG. 5), or variety of one or more height positions or distances. Further in some embodiments as is shown and discussed herein, one or more slides 64 may be positionable with the dishwasher rack 20 between the first height and the second height. Although the threaded member 44 is shown as a block or nut with a threaded opening receiving the worm screw 42, a variety of threaded members may be used in different quantities, construction, shape, orientations and still operably engage the worm screw 42. Rotation of the motor 32 may rotate the drive shaft 34 and worm screw 42 clockwise and/or counterclockwise. Because the threaded member 44 is fixed to the dishwasher rack 20, rotation of the worm screw 42 moves (i.e. but not limited to linearly) the threaded member 44 and dishwasher rack 20 between a variety of vertical positions in any number of horizontal positions between the stowed and deployed positions, depending on the direction of rotation of the worm screw 42. The electric motor 32 may be engaged in the appropriate rotational direction by a controller in some embodiments.

As shown in the figures, in some embodiments the dishwasher rack 20 may be connected to the threaded member 44 by a rack support 50. The rack support 50 may be fixed to the threaded member 44 such that the rack support 50 and threaded member 44 travel vertically between various positions or heights. The rack support 50 may surround at least a portion of the outer periphery of the dishwasher rack 20. In one embodiment, the rack support 50 may include an elongated rear member 52 adjacent the rear wall 14*a* and/or proximal end of the dishwasher rack 20. At each end of the rear member 52 of the rack support 50 a lateral arm 54 may project from the rear member 52 towards the distal end of the dishwasher rack and/or opening 13. Although the rack support 50 is shown as substantially U-shaped in a horizontal plane, the rack support 50 may be a variety of quantities, sizes, shapes, orientations, and constructions and still be within the scope of the invention.

Figure 7:
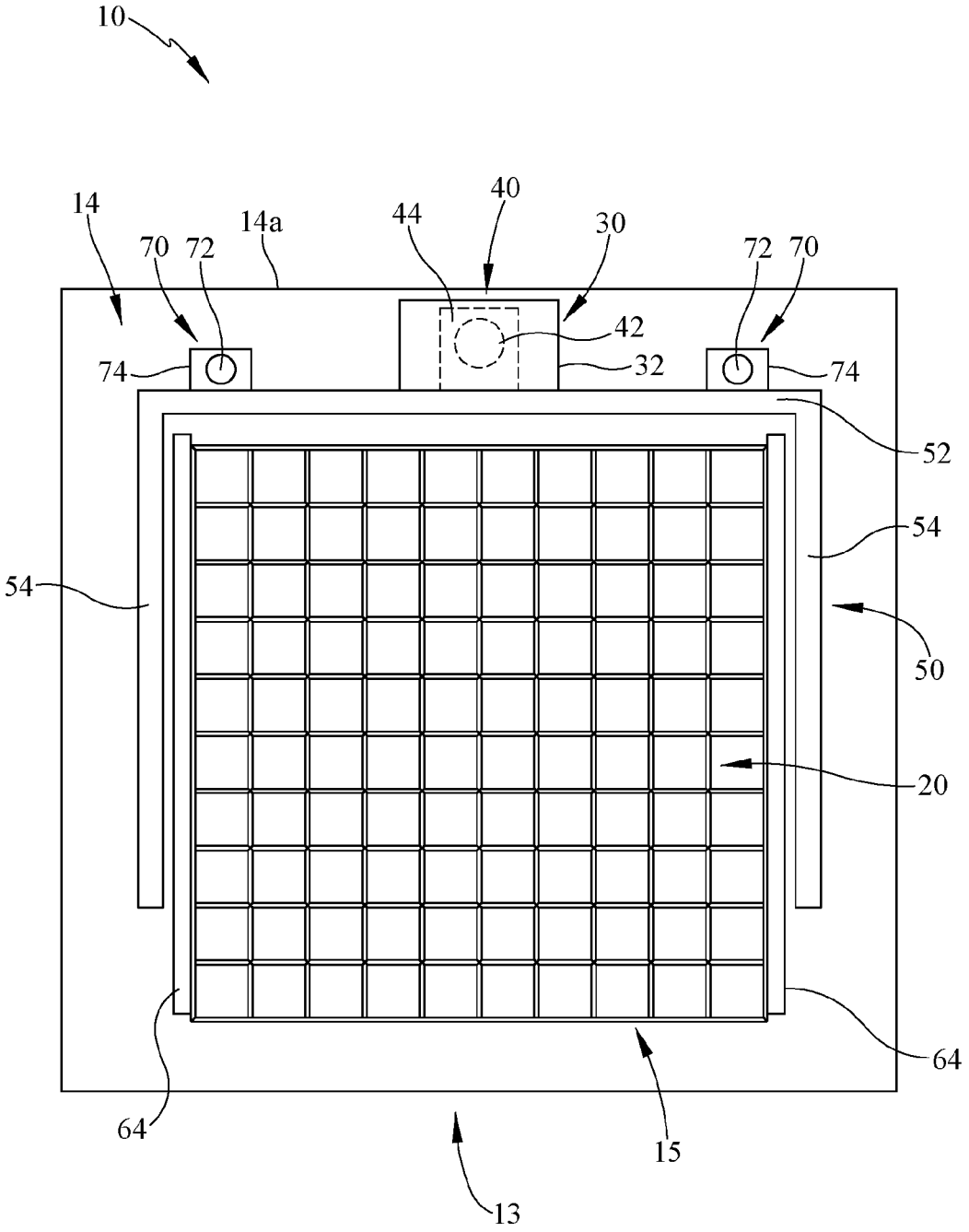
FIG. 7 is a schematic top view of the dishwasher rack of FIG. 2 illustrating one embodiment of a guide mechanism.
Figure 8:
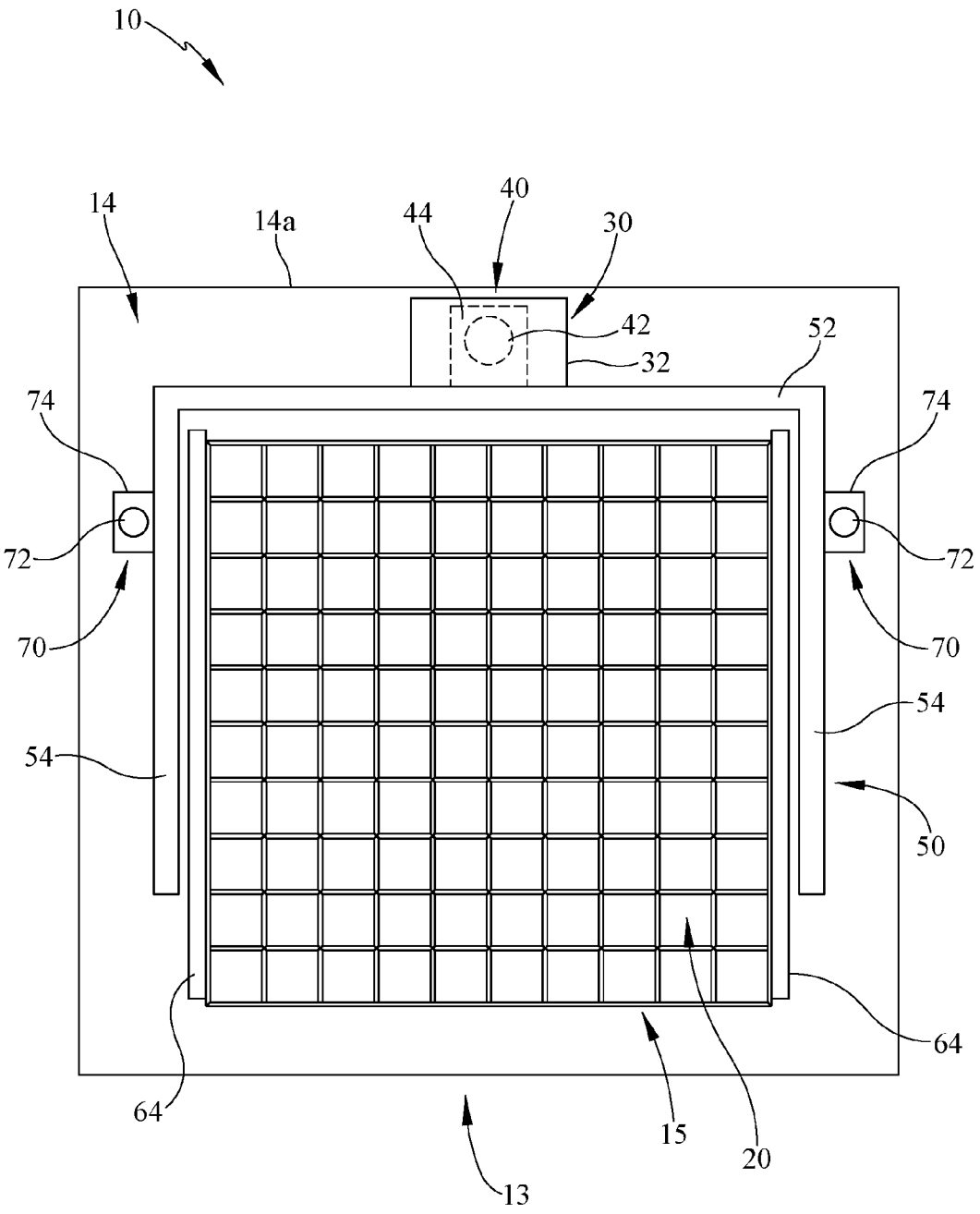
FIG. 8 is a schematic top view of the embodiment of FIG. 7 illustrating the guide mechanism in another location relative to the rack support.
Figure 9:
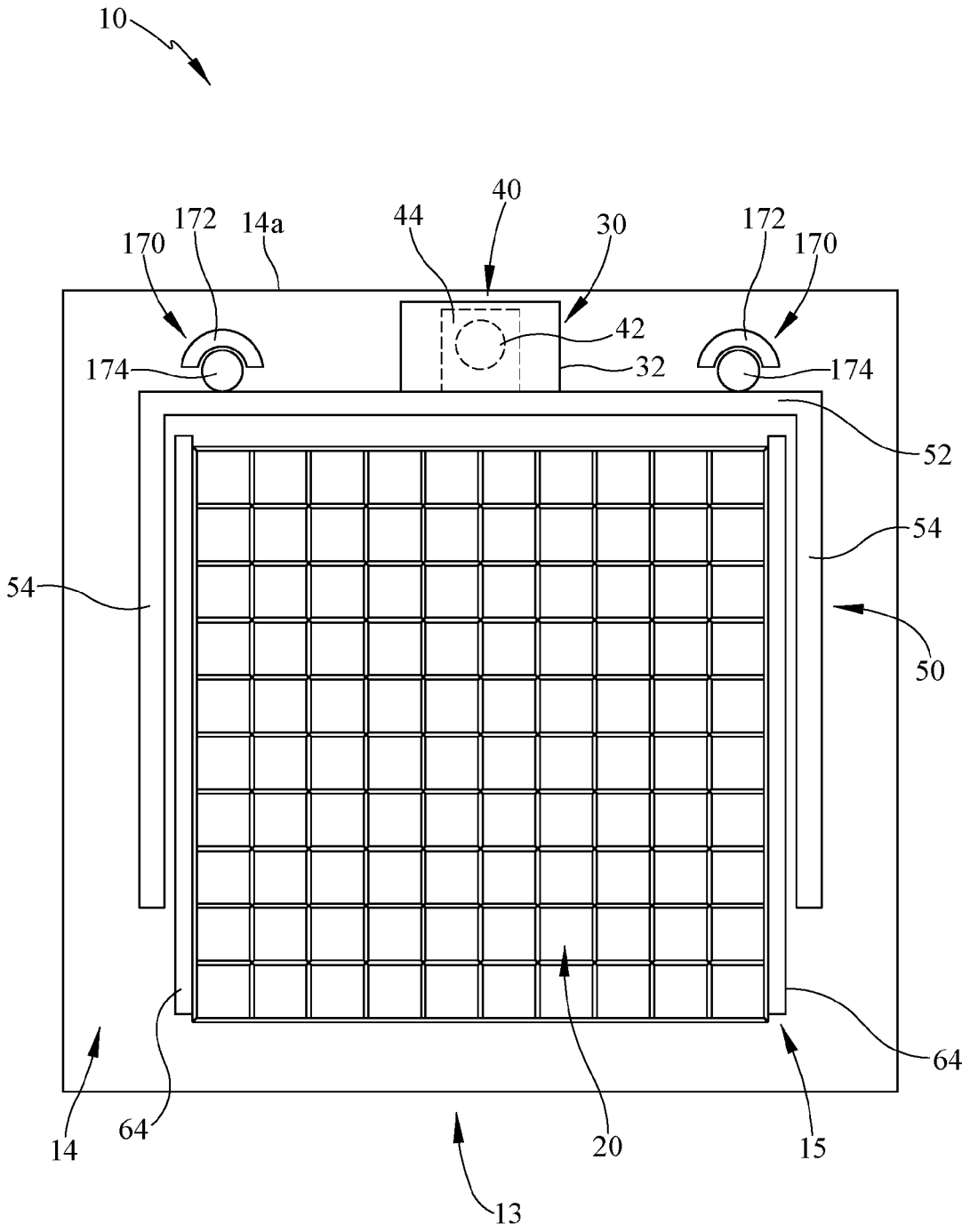
FIG. 9 is a schematic top view of the dishwasher rack of FIG. 2 illustrating another embodiment of a guide mechanism.
Figure 10:
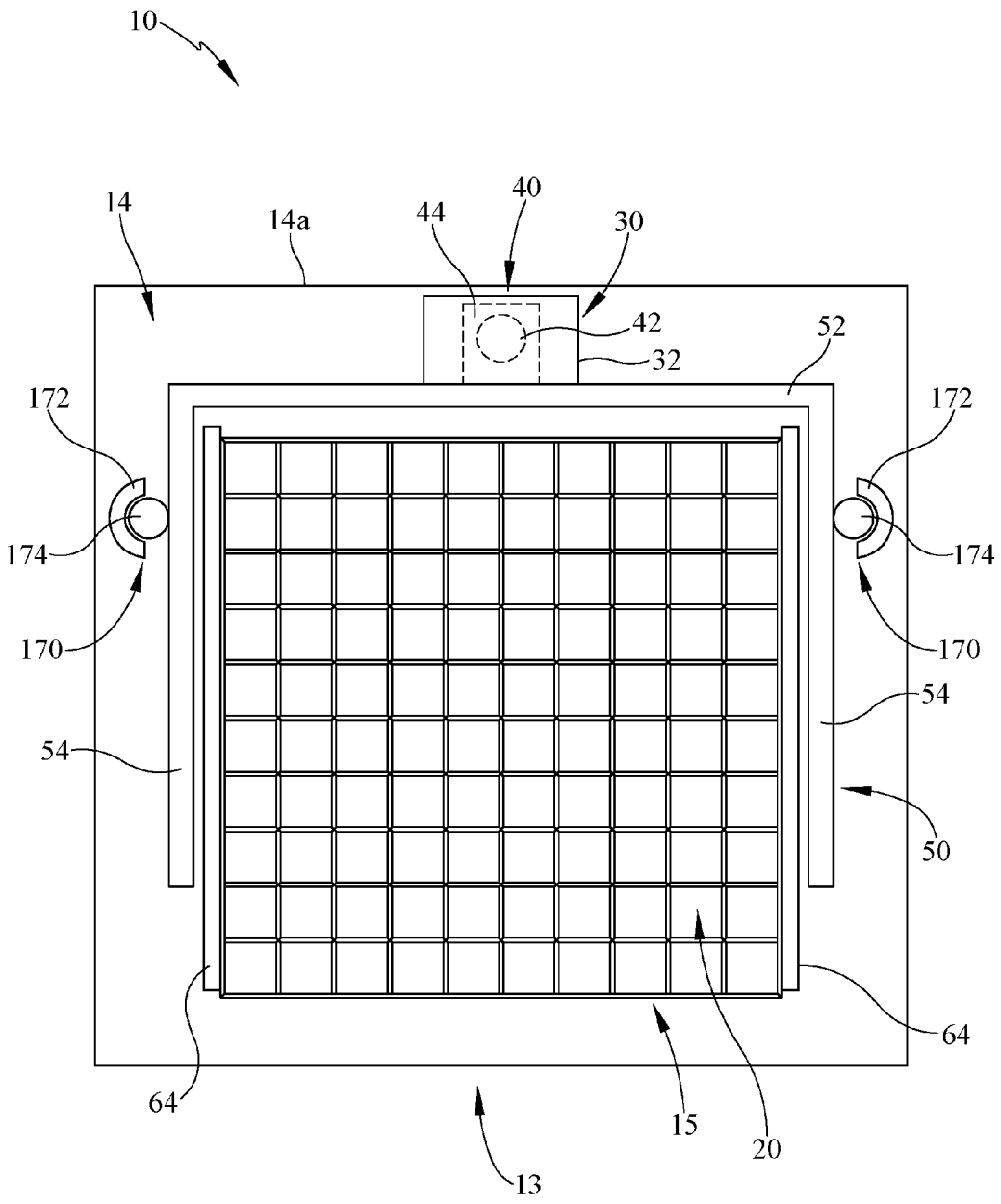
FIG. 10 is a schematic top view of the embodiment of FIG. 9 illustrating the guide mechanism in another location relative to the rack support.

In some embodiments as shown in FIGS. 7-10, the dishwasher rack 20 may be coupled to one or more guide mechanisms 70, 170. The guide mechanism may be positioned at one or more locations to guide and support the vertical movement or height position of the dishwasher rack 20. In FIGS. 7 and 9, the one or more guide mechanisms 70, 170 may be positioned at the rear member 52. In other embodiments as shown in FIGS. 8 and 10, the guide mechanisms 70, 170 may be positioned anywhere along one or more lateral arms 54. Moreover, the guide mechanisms may be included in one or more of the lateral arms 54 and also the rear member 52 in some embodiments. The guide mechanism may be a variety of quantities, sizes, orientations, positions, and constructions and still be within the scope of the invention. For example in one embodiment of the guide mechanism 70 as shown in FIGS. 7 and 8, one or more guide rods 72 may be mounted vertically within the dishwasher tub 14 and at least one guide block 74 may be coupled with the rack support 50 to receive the corresponding guide rod 72 therethrough such that dishwasher rack 20 and guide block 74 may move vertically along the guide rod 72. Moreover in various embodiments of the guide mechanism 170 as shown in FIGS. 9 and 10, vertically orientated and elongated guide tracks or rails 172 define a receiving slot to receive a corresponding guide protrusion or projection 174 from the rack support 50 to support and guide the dishwasher rack's vertical movement and may reduce the lateral movement thereof.

In some embodiments, the dishwasher rack 20 may be self-locking in one or more height positions. In one embodiment, the interaction of the geometry of the worm screw 42 and threaded member 44 self-locks such that the dishwasher rack 20 may not be raised and/or lowered unless the worm screw 42 is being rotated. It is understood that a variety of self-locking mechanisms may be used to limit travel of the dishwasher rack. For example, the guide mechanism 70 and/or rack support 50 may include self-locking features that engage and/or disengage operably by the user and/or controller. For example a locking tab, clip, and/or releasable catch may be used. Moreover for example, one or more locks may engage if the rack 20 is loaded or of a particular or sufficient first weight, and/or may disengage if the dishwasher rack 20 is unloaded or of a particular or sufficient second weight. The first weight may be larger than the second weight in some embodiments.

As shown in the figures, in some embodiments the one or more dishwasher racks 20 may include a variety of attachments 60 to deploy and/or retract the dishwasher racks relative to the dishwasher tub 14 and/or rack support 50. In some embodiments as shown in the figures, the attachment 60 is in the form of one or more slides or rails 64. It should be understood that a variety of attachments 60 may be used such, as but not limited to, wheels 62. One or more wheels 62 may allow the dishwasher rack 20 to be in rolling contact with the rack support 50. Wheels 62 may be used in combination with rails 64 in various embodiments. In some embodiments as shown in FIGS. 1, 3, and 4, the dishwasher rack 20 may include one or more rails or slides 64 engaging the rack support 50 allowing the linear or horizontal travel of the dishwasher rack between the stowed position and the deployed position. Although the engagement between the rack support 50 and the dishwasher rack 20 is shown in one embodiment, a variety of attachments and/or mechanisms may be used to allow movement of the dishwasher rack relative to the dishwasher tub, threaded member 44, and/or rack support 50 and still be within the scope of the invention disclosed herein.

In various embodiments as shown in the figures, the drive mechanism 30, gear mechanisms 40, guide mechanisms 70, 170, and/or one or more threaded members 44 may be positioned adjacent the rear portion of the dishwasher tub 14. The worm screw 42, the threaded member 44, and/or motor 32 may be positioned adjacent the rear wall 14*a* of the dishwasher tub 14 that defines a portion of the wash cavity 15. This location distal from the opening 13 may reduce contact with the user. Moreover, the gear mechanism 40, rack support 50, threaded member 44, and/or guide mechanism 70, 170 might not project out of the opening 13 in some embodiments. As is shown at least in FIGS. 1-3, the worm screw 42 is positioned within the wash cavity 15, or more specifically in some embodiments between the dishwasher rack 20 and the rear wall 14*a*. It should be understood that the one or more worm screws 42 and/or threaded members 44 may be positioned at a variety of locations within in the dishwasher tub 14 spaced away from the opening 13 and/or at various positions relative to the dishwasher rack 20.

In some embodiments of the dish washing appliance 10 as shown in FIGS. 1 and 3-5, the dishwasher tub 14 may include two or more racks 20. Although in some embodiments that the dishwasher rack 20 with lift system is the bottom rack of the appliance 10 as shown in FIGS. 1-5, it should be understood that the lift system may be used with the upper rack, alone or combined with the lower rack. The lower dishwasher rack 20 may include wheels 62, if used, and be raised and/or lowered. In some embodiments, wheels 62 may not be used. The upper rack 20 may include slides 64 as shown and may or may not be raised and/or lower in some embodiments. However, it should be understood that the lower and/or upper rack, or respective portions thereof, may be lowered or raised in various embodiments hereof. Moreover, one or more racks or portions thereof may be raised and/or lowered together and/or separately. Further, one or more racks 20 or portions of one or more racks may be driven between heights independently and/or dependently from another rack and/or portions of racks thereof. For example, one or more rack portions may move vertically relative to the remaining rack portions before and/or after the remaining portions travel. Further, some dishwasher racks may move before and/or after another rack to correspond to a user's preference, for example when loading and/or unloading the one or more dishwasher racks of the appliance 10. In should be understood that in some embodiments, the one or more dishwasher racks may travel between a first height and second height when the door 12 is in a closed and/or open position.

As shown in FIG. 6, another embodiment of the gear mechanism 40 between the drive mechanism 30 and dishwasher rack 20 may be used to position the dishwasher rack 20 between the first height and the second height. The dishwasher rack 20 may be coupled to the motor 32 and drive shaft 34 by the gear mechanism 40 that includes a worm screw 42 and worm wheel 46. The worm wheel 46 may be a gear or threaded member such that the rotation of the worm wheel 46 by the motor 32 rotates the worm screw 42 in one or more rotational directions, thereby translating the threaded member 44 and dishwasher rack 20 up and/or down in the corresponding direction along a length of the worm screw 42.

Although the dishwasher rack 20 is shown schematically in the figures, it should be understood that the dishwasher rack may be a variety of sizes, shapes, quantities, and construction and still be within the scope of the teachings herein. For example, the dishwasher rack 20 may have a first portion that may move between a variety of vertical positions in any number of horizontal positions between the stowed and deployed positions separately and/or together with another portion of the rack and/or other rack.

In operation, embodiments of the dishwasher rack 20 may be operated by one or more control panels 18. As is shown in the embodiments, a control panel 18 may be outside the door 12. However, the control panels may be inside and/or outside the door. In use, the extension and/or retraction of the dishwasher rack may be selected by the user. The duration of travel, distance of travel, first height, second height, and one or more height positions all may be preset, depending upon characteristics of the dishwasher rack (i.e. weight, size, and/or quantity of items to be cleaned, capacity available and/or not available, loaded or unloaded conditions, or the like), or can be predetermined. Also, preprogramed cycles or modes may also be used to position the dishwasher rack.

It should be understood that in some embodiments, dish washing appliance 10 and/or dishwasher rack 20 may be, in whole or in part, under the control of a controller (not shown) that receives inputs from a number of components and drives a number of components in response thereto. The controller may, for example, include one or more processors and a memory (not shown) within which may be stored program code for execution by the one or more processors. The memory may be embedded in the controller, but may also be considered to include volatile and/or non-volatile memories, cache memories, flash memories, programmable read-only memories, read-only memories, etc., as well as memory storage physically located elsewhere from controller, e.g., in a mass storage device or on a remote computer interfaced with a controller.

The controller may be interfaced with various components, including the aforementioned dishwasher tub 14, dishwasher rack 20, door 12, drive mechanism 30, gear mechanism 40, guide mechanisms 70, 170, sensors (not shown), etc. For example, the sensors may include limit switches and/or contact switches that maintain the one or more deployed and/or stowed positions while one or more vertical adjustments in height occur. In some embodiments, one or more sensors may also be used to position one or more racks from encroaching into a space and/or close proximity of another rack or their respective contents. For example, the use of a sensor may allow the rack to be raised and/or lowered only when the rack has reached a deployed position such as to allow the lower rack to be raised vertically without encroaching with the upper rack. In addition, controller may be coupled to a user interface 19 including various input/output devices such as knobs, dials, sliders, switches, buttons, lights, textual and/or graphics displays, touch screen displays, speakers, image capture devices, microphones, etc. for receiving input from and communicating with a user, e.g., as may be disposed in a control panel 18. In some embodiments, a controller may also be coupled to one or more network interfaces, e.g., for interfacing with external devices via wired and/or wireless networks such as Ethernet, Bluetooth, NFC, cellular, and other suitable networks. Additional components may also be interfaced with a controller, as will be appreciated by those of ordinary skill having the benefit of the instant disclosure. Moreover, in some embodiments, at least a portion of controller may be implemented externally from a dish washing machine, e.g., within a mobile device, a cloud computing environment, etc., such that at least a portion of the functionality described herein is implemented within the portion of the controller that is externally implemented.

In some embodiments, a controller may operate under the control of an operating system and may execute or otherwise rely upon various computer software applications, components, programs, objects, modules, data structures, etc. In addition, controller may also incorporate hardware logic to implement some or all of the functionality disclosed herein. Further, in some embodiments, the sequences of operations performed by controller to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dish washing appliance comprising:

a dishwasher tub defining a wash cavity;

one or more dishwasher racks positioned within the wash cavity of the dishwasher tub, at least one of the dishwasher racks is moveable between a stowed position and a deployed position, wherein the deployed position is different from the stowed position;

at least one threaded member;

one or more slides coupling the at least one dishwasher r rack to the at least one threaded member;

at least one motor;

at least one worm screw located within the wash cavity and operably coupled to the at least one motor;

the at least one threaded member and the at least one dishwasher rack connected to the at least one worm screw, wherein the at least one threaded member, the one or more slides, and the at least one dishwasher rack is positionable between a first height and a second height along a length of the at least one worm screw when the at least one dishwasher rack is in the deployed position, wherein the second height is at a higher vertical elevation than the first height; and wherein the at least one threaded member and the at least one worn screw are positioned adjacent a rear wall of the dishwasher tub.

2. The dish washing appliance of claim 1 wherein the at least one worm screw is located between the at least one rack and the rear wall of the dishwasher tub.

3. The dish washing appliance of claim 1 wherein the at least one dishwasher rack is in the stowed position in at least one height between the first height and the second height along the at least one worm screw.

4. The dish washing appliance of claim 1 further including a rack support fixed to the at least one threaded member, wherein the rack support includes the one or more slides.

5. The dish washing appliance of claim 4 further comprising one or more guide mechanisms between the rack support and the dishwasher tub.

6. The dish washing appliance of claim 5 wherein the one or more guide mechanisms are adjacent a rear wall of the dishwasher tub.

7. A dish washing appliance comprising:

a dishwasher tub defining a wash cavity, wherein the dishwasher tub includes a rear wall;

one or more dishwasher racks, at least one of the dishwasher racks is positionable within the wash cavity of the dishwasher tub;

at least one threaded member;

at least one motor;

at least one worm screw positioned within the wash cavity between the at least one dishwasher rack and the rear wall, the at least one worm screw operably coupled to the at least one motor;

the at least one threaded member and the at least one dishwasher rack connected to the at least one worm screw, wherein the at least one threaded member and the at least one dishwasher rack is positionable between a first height and a second height along the at least one worm screw, wherein the second height is at a higher vertical elevation than the first height; and the at least one dishwasher rack is positionable between a stowed position and a deployed position when the at least one threaded member and the at least one dishwasher racks are capable of being positioned at one or more heights between the first height and the second height, wherein the deployed position is different from the stowed position;

wherein the at least one dishwasher rack includes one or more slides engaging the at least one dishwasher rack to the at least one threaded member;

a rack support fixed to the at least one threaded member, wherein the rack support includes the one or more slides; and one or more guide mechanisms between the rack support and the dishwasher tub, wherein the one or more guide mechanisms are adjacent the rear wall of the dishwasher tub.

8. The dish washing appliance of claim 7 wherein the at least one motor is positioned outside the wash cavity.

9. The dish washing appliance of claim 7 wherein the one or more heights include at least one of the first height and the second height.

10. The dish washing appliance of claim 7 wherein the at least one threaded member and the at least one dishwasher rack is positionable between the first height and the second height along the at least one worm screw when in the deployed position.

11. A dish washing appliance comprising:

a dishwasher tub, wherein the dishwasher tub includes at least a rear wall therein defining a wash cavity;

one or more dishwasher racks, at least one of the dishwasher racks is positioned within the wash cavity of the dishwasher tub;

at least one threaded member;

at least one motor;

at least one worm screw operably coupled to the at least one motor, wherein the at least one worm screw is fixedly positioned in a substantially vertical orientation adjacent the rear wall of the dishwasher tub;

the at least one threaded member and the at least one dishwasher rack connected to the at least one worm screw, wherein the at least one threaded member and the at least one dishwasher rack is positionable between a first height and a second height along the at least one worm screw, wherein the second height is at a higher vertical elevation than the first height; and the at least one dishwasher rack is positionable between a stowed position and a deployed position when the at least one threaded member and the at least one dishwasher rack are at one or more heights between the first height and the second height, wherein the deployed position is different from the stowed position.

12. The dish washing appliance of the claim 11 wherein the one or more dishwasher racks is an upper dishwasher rack positioned above a lower dishwasher rack.

13. The dish washing appliance of claim 11 wherein the at least one worm screw is located within the wash cavity of the dishwasher tub.

14. The dish washing appliance of claim 11 wherein the at least one dishwasher rack includes one or more slides engaging the at least one dishwasher rack to the at least one threaded member.

15. The dish washing appliance of claim 14 further including a rack support fixed to the at least one threaded member, wherein the rack support includes the one or more slides.

16. The dish washing appliance of claim 15 further comprising one or more guide mechanisms between the rack support and the dishwasher tub.

17. The dish washing appliance of claim 11 wherein the at least one threaded member and the at least one dishwasher rack is positionable between the first height and the second height along the at least one worm screw when in the deployed position.

18. A dish washing appliance comprising:

a dishwasher tub defining a wash cavity;

one or more dishwasher racks positioned within the wash cavity of the dishwasher tub, at least one of the dishwasher racks is moveable between a stowed position and a deployed position, wherein the deployed position is different from the stowed position;

at least one threaded member;

one or more slides coupling the at least one dishwasher rack to the at least one threaded member;

at least one motor;

at least one worm screw located within the wash cavity and operably coupled to the at least one motor;

the at least one threaded member and the at least one dishwasher rack connected to the at least one worm screw, wherein the at least one threaded member, the one or more slides, and the at least one dishwasher rack is positionable between a first height and a second height along a length of the at least one worm screw when the at least one dishwasher rack is in the deployed position, wherein the second height is at a higher vertical elevation than the first height;

a rack support fixed to the at least one threaded member, wherein the rack support includes the one or more slides; and one or more guide mechanisms between the rack support and the dishwasher tub, wherein the one or more guide mechanisms are adjacent a rear wall of the dishwasher tub.

* * * * *